US009032555B2

(12) United States Patent
Kim

(10) Patent No.: US 9,032,555 B2
(45) Date of Patent: May 19, 2015

(54) VISOR CAP HAVING VARIABLE VISORS

(76) Inventor: Sung Gyu Kim, Busan (KR)

( * ) Notice: Subject to any disclaimer, the term of this patent is extended or adjusted under 35 U.S.C. 154(b) by 148 days.

(21) Appl. No.: 13/384,983

(22) PCT Filed: Jul. 19, 2010

(86) PCT No.: PCT/KR2010/004706

§ 371 (c)(1),
(2), (4) Date: Jan. 19, 2012

(87) PCT Pub. No.: WO2011/010847

PCT Pub. Date: Jan. 27, 2011

(65) Prior Publication Data

US 2012/0110718 A1 May 10, 2012

(30) Foreign Application Priority Data

Jul. 22, 2009 (KR) ..... 10-2009-0066914

(51) Int. Cl.
*A42B 1/00* (2006.01)
*A42B 1/06* (2006.01)

(52) U.S. Cl.
CPC ..... *A42B 1/065* (2013.01); *A42B 1/062* (2013.01)

(58) Field of Classification Search
CPC ..... A42B 1/00; A42B 1/06; A42B 1/061; A42B 1/062; A42B 1/063; A42B 1/065; A42B 1/066; A42B 1/068; A42B 1/069
USPC ..... 2/6.5, 15, 10, 9, 181.4, 182.2, 184.5, 2/209.12, 209.13, 175.1, 195.1, 195.2, 2/195.7
See application file for complete search history.

(56) References Cited

U.S. PATENT DOCUMENTS 566,326 A * 8/1896 Kirshner ..... 2/10
716,258 A * 12/1902 Maass ..... 2/10

(Continued)

FOREIGN PATENT DOCUMENTS

KR 1020050037077 4/2005
KR 10-0555729 2/2006

(Continued)

OTHER PUBLICATIONS

International Search Report for PCT/KR2010/004706 Mailed on April 25, 2011.

*Primary Examiner* — Alissa L Hoey
(74) *Attorney, Agent, or Firm* — Revolution IP, PLLC

(57) ABSTRACT

The present invention relates to a visor cap. It is an aim of the present invention to provide a visor cap which can widen a sun blocking area through variable visors and which enables a wearer to adjust the sun-blocking area while improving wearing comfort. To accomplish the aim, provided is a visor cap including a main body, a fixed visor, and a pair of variable visors hinged to both sides of an upper surface or a lower surface of the fixed visor, so as to vary the sun-blocking area, wherein each of the pair of variable visors includes: a first variable visor portion which is made of a textile material and one side of which is fixed at an edge of the fixed visor; and a second variable visor portion which is made of a synthetic resin material and which is coupled to the other side of the first variable visor portion. The visor cap of the present invention is advantageous in that it enables a wearer to adjust the sun-blocking area if needed, and is prevented from contacting the skin of the wearer, thus improving is wearing comfort while expanding the sun-blocking area.

4 Claims, 5 Drawing Sheets

(56) References Cited

U.S. PATENT DOCUMENTS

| | | | | | |
|---|---|---|---|---|---|
| 1,610,745 | A | * | 12/1926 | Castanaro | 2/195.1 |
| 1,716,719 | A | * | 6/1929 | Christopher | 2/10 |
| 2,274,222 | A | * | 2/1942 | Tedrow | 2/10 |
| 2,717,385 | A | * | 9/1955 | Linster | 2/10 |
| 2,878,479 | A | * | 3/1959 | Schuessler | 2/172 |
| 4,321,708 | A | * | 3/1982 | Troiano | 2/10 |
| 4,793,006 | A | * | 12/1988 | Dawson | 2/195.1 |
| 5,007,110 | A | * | 4/1991 | Gilbert | 2/10 |
| 5,075,898 | A | * | 12/1991 | Bedient | 2/10 |
| 5,197,150 | A | * | 3/1993 | Bedient | 2/10 |
| 5,473,778 | A | * | 12/1995 | Bell | 2/10 |
| 5,544,361 | A | * | 8/1996 | Fine et al. | 2/10 |
| 5,553,325 | A | * | 9/1996 | Gutierrez | 2/171 |
| 5,581,807 | A | * | 12/1996 | Peterson | 2/10 |
| 5,621,915 | A | * | 4/1997 | Schneider et al. | 2/10 |
| 5,687,420 | A | * | 11/1997 | Chong | 2/10 |
| 5,689,827 | A | * | 11/1997 | Ryder | 2/10 |
| 5,689,830 | A | * | 11/1997 | Pflum | 2/195.1 |
| 5,815,832 | A | * | 10/1998 | Skolik | 2/10 |
| 5,839,125 | A | * | 11/1998 | Chen | 2/195.1 |
| 5,901,371 | A | * | 5/1999 | Lee | 2/10 |
| 5,930,834 | A | * | 8/1999 | Toovey | 2/10 |
| 5,987,640 | A | * | 11/1999 | Ryder | 2/10 |
| 6,012,176 | A | * | 1/2000 | Daley, III | 2/209.13 |
| 6,079,052 | A | | 6/2000 | Veridiano | |
| 6,088,837 | A | * | 7/2000 | Baker | 2/195.1 |
| 6,173,447 | B1 | * | 1/2001 | Arnold | 2/10 |
| 6,202,218 | B1 | * | 3/2001 | Chen | 2/195.1 |
| 6,473,907 | B1 | * | 11/2002 | Harwood | 2/209.13 |
| 6,641,266 | B1 | * | 11/2003 | Lazarus | 351/155 |
| 6,804,831 | B2 | * | 10/2004 | Guerra | 2/209.11 |
| D499,231 | S | * | 12/2004 | Toppel | D2/882 |
| 6,959,454 | B2 | * | 11/2005 | DeWinter | 2/195.1 |
| 7,185,371 | B2 | * | 3/2007 | Koo | 2/209.13 |
| 7,343,630 | B2 | * | 3/2008 | Lee | 2/175.6 |
| 7,703,153 | B2 | * | 4/2010 | de Taboada | 2/422 |
| 2004/0158912 | A1 | * | 8/2004 | DeWinter | 2/195.1 |
| 2005/0257310 | A1 | * | 11/2005 | Jang | 2/209.13 |
| 2006/0143792 | A1 | * | 7/2006 | No | 2/195.2 |
| 2011/0283441 | A1 | * | 11/2011 | Orman | 2/195.7 |
| 2012/0260399 | A1 | * | 10/2012 | Verbout | 2/209.12 |

FOREIGN PATENT DOCUMENTS

| | | |
|---|---|---|
| KR | 20-0437744 | 12/2007 |
| KR | 10-2009-0070006 | 7/2009 |

* cited by examiner

VISOR CAP HAVING VARIABLE VISORS

RELATED APPLICATIONS

This application is a 371 application of International Application No. PCT/KR2010/004706, filed Jul. 19, 2010, which in turn claims priority from Korean Patent Application No. 10-2009-0066914, filed Jul. 22, 2009, each of which is incorporated herein by reference in its entirety.

TECHNICAL FIELD

The preset invention relates to a visor cap, and in particular to a visor cap having an accommodation function and variable visors which is made from different materials and has an adjustable visor area.

BACKGROUND ART

A visor cap generally aims to protect a user's face from a strong sunshine with a visor designed to interrupt sunshine being relatively wider than a common cap.

The conventional visor cap is characterized in that a visor designed to protect sunshine is generally fixed, which brings in some limits in interrupting sunshine (in particular, at the sides of a cap). In the event that a visor is too sizable, such bigger visor might obstruct a user's field of vision when there is not sunshine or sunshine is weak.

In order to overcome the above problems, a Japanese laid-open patent publication 2006-225825, a Korean patent application number 20-2000-0002572 and a Korean utility model registration number 0437323 disclose some technologies changing the lengths of a visor.

Among the above prior arts, the Japanese laid-open patent publication 2006-225825 is characterized in that a pair of assistant visors are fixedly hinged at a fixed visor, thus adjusting a visor area, and the Korean utility model registration number 0437323 (a cap with a variable visor) is characterized in that a cap covering a user's head, a fixed visor fixed at a front side of the cap, and a variable visor sliding at both sides of a fixed visor. In more details, there are provided a fixing visor with a guide being integral with a visor board, and a slide part provided at both sides of a fixing visor in opposite directions and protruded from one side of a variable visor part. The slide part comprises a pair of variable visors each having a guide groove for an insertion into a guide, and a cover fixed at a front end portion and a rear end portion of a lower side of a fixed visor, thus supporting a variable visor.

In the above-described prior art, in the event that a variable visor is made from a hard material such as a plastic material or the like, the size of a variable visor is limited to the extent that it can be accommodated into a fixed visor, which brings in a problem that sunshine coming in from a lateral side cannot be effectively interrupted. In the event that a variable visor is made from a woven material, a variable visor might come into direct contact with a users skin, which makes a wearing feeling worse.

The conventional art is disadvantageous in the facts that a visor area of a variable visor cannot be adjusted.

DISCLOSURE OF INVENTION

Accordingly, it is an object of the present invention to provide a visor cap which overcomes the problems encountered in the conventional art, with a variable visor area being adjusted by a user, with a variable visor area being wider than the area of a fixed visor area.

It is another object of the present invention to provide a visor cap which has an excellent wearing feeling.

To achieve the above objects, there is provided a visor cap having variable visors, comprising a body; a fixed visor; and a pair of variable visors which are hinged at both sides of an upper surface or a lower surface of the fixed visor, thus adjusting the visor area, wherein said variable visor comprises a first variable visor part one side surface of which is fixed at a rim part of the fixed visor, with the first variable visor part being made from a woven material; and a second variable visor part which is hinged at a side surface of the fixed visor and is coupled at the other side surface of the first variable visor part, with the second variable visor part being made from a synthetic resin.

Here, the first variable visor part is made from a spandex woven material.

In the event that the variable visor is installed beneath the fixed visor, an accommodation part is disposed beneath the fixed visor for thereby accommodating the variable visors therein.

In addition, there is provided a coupling means for coupling the body and the variable visor in order for the variable visor to be fixed in an expanded state. The coupling means is either a Velcro tape or a snap button.

Finally, there is provided a fixing means for coupling the fixed visor and the variable visor in order for the variable visor to be fixed in a folded state. The fixing means is a Velcro tape.

ADVANTAGEOUS EFFECTS

The visor cap having variable visors according to the present invention is characterized in that a variable visor is formed of a first variable visor part made from a spandex woven material and a second variable visor part made from a synthetic resin, so a user can freely adjust a variable area, with a visor area being wider than that of a fixed visor.

Even when a visor area is expanded, a visor does not contact with a users skin, which results in an excellent wearing feeling in a visor cap.

BRIEF DESCRIPTION OF THE DRAWINGS

The present invention will become better understood with reference to the accompanying drawings which are given only by way of illustration and thus are not limitative of the present invention, wherein.

BEST MODES FOR CARRYING OUT THE INVENTION

The visor cap having variable visors according to the present invention will be described with reference to the accompanying drawings.

Figure 1:
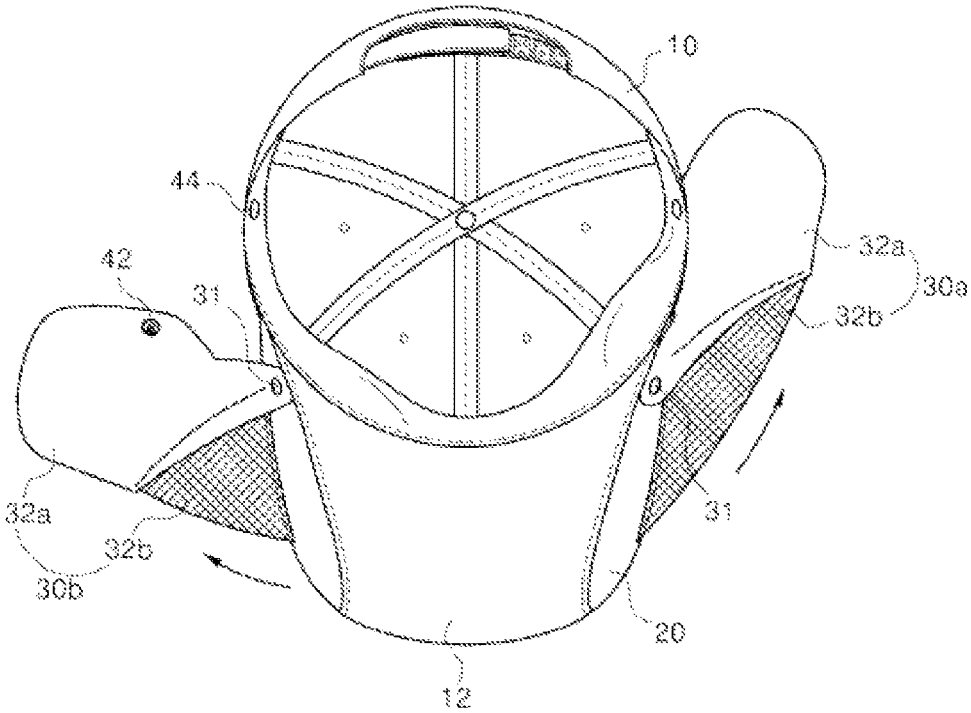
FIG. 1 is a bottom view illustrating a visor cap having a variable visor according to a preferred embodiment of the present invention.
Figure 2:
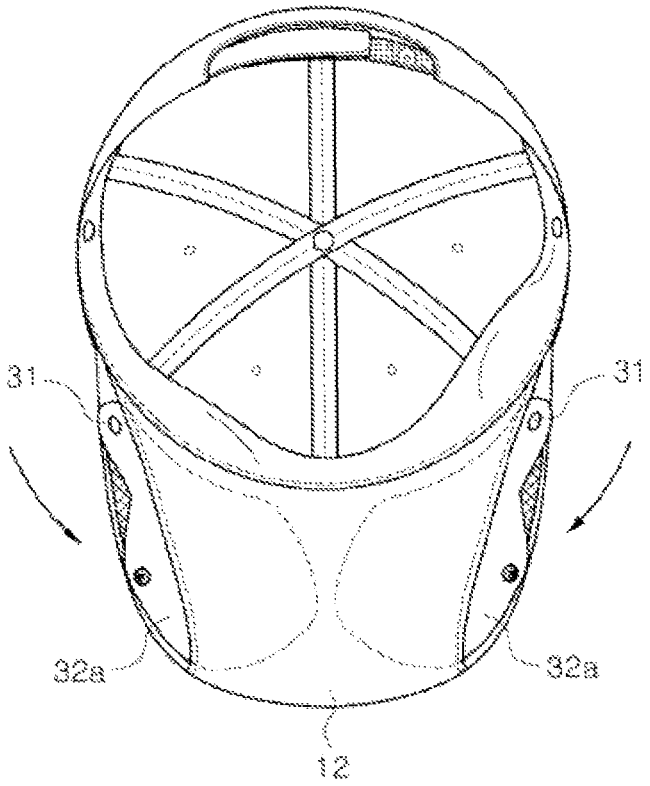
FIG. 2 is a view illustrating a change from FIG. 1.

FIG. 1 is a bottom view illustrating a visor cap having variable visors according to a preferred embodiment of the present invention, and FIG. 2 is a view illustrating a change from FIG. 1.

As shown in FIG. 1, the visor cap having variable visors according to the present invention comprises a body 10, a fixed visor 20, and a pair of variable visor parts 30*a* and 30*b* each hinged at the fixed visor 20, the construction of which is same as the conventional art.

The pair of the variable visor parts 30*a* and 30*b* are generally hinged beneath the fixed visor 20 and can be expanded for a wider area, when needed.

In details, the variable visors each comprise a first variable visor part 32*b* one side of which is fixed at a rim portion of the fixed visor 20 with the variable visor each being made from a woven material, and a second variable visor part 32*a* which is hinged at a side portion of the fixed visor 20 by means of a hinge part 31 and is coupled with the other side portion of the first variable visor part 32*b* and is made from a synthetic resin.

Here, it is preferred that the first variable visor part 32*b* is made of a spandex woven material with a certain flexibility.

As shown in FIG. 1, in the event that the variable visor (first variable visor part 32*b* and second variable visor part 32*a*) is installed beneath the fixed visor 20, an accommodation part 12 is formed beneath the fixed visor 20, thus accommodating the variable visor.

As shown in FIG. 2, it is preferred that the accommodation part 12 is fixed at the front and rear sides of the fixed visor 20 and can be received into the inner side of the accommodation part 12 both sides of which are open in such a way to rotate the second variable visor part 32*a* about the hinge part 31.

It is preferred that there is a coupling means for coupling the body 10 and the variable visor in order for the variable visors to be fixed in a state that the variable visors are expanded, and the coupling means might be formed of either a Velcro tape or a snap button.

As shown in FIG. 1, in the event that the snap button is used, a female button is installed at the second variable visor part 32*a*, and a male button is installed at the side of the body 10, thus coupling with each other with the variable being expanded.

Figure 3:
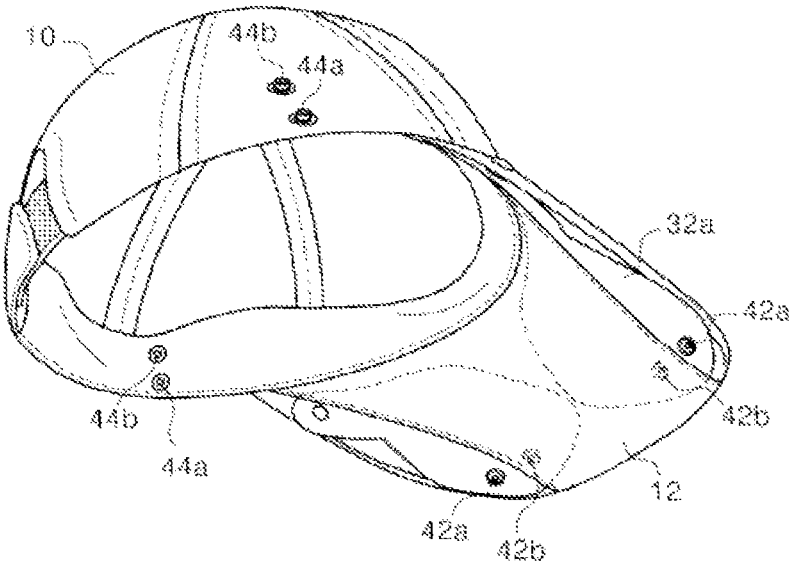
FIG. 3 is a perspective view illustrating a visor cap having variable visors according to a preferred embodiment of the present invention.
Figure 4:
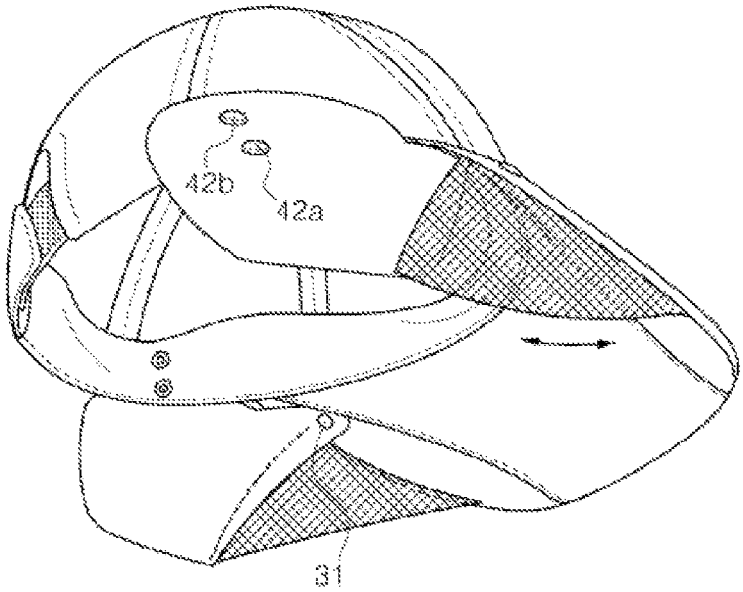
FIG. 4 is a view illustrating a change from FIG. 3.

FIG. 3 is a perspective view illustrating a visor cap having variable visors according to a preferred embodiment of the present invention, and FIG. 4 is a view illustrating a change from FIG. 3.

The first variable visor part 32*b* of the present invention can be expandable since it is made from a flexible cloth material. When the coupling means is formed of a snap button as shown in FIG. 3, a plurality of female buttons 42*a* and 42*b* and a plurality of male buttons 44*a* and 44*b* are used, so the visor area can be adjusted by changing the positions where the second variable visor part 32*a* is fixed at the body 10.

For an additional feature, it is preferred that the snap button installed at the body 10 is installed at an inner side surface, thus hiding the same from the outside for a better looking. In the event that the Velcro tape is used, a Velcro with a smooth surface is installed at the second variable visor part 32*a*, and a Velcro with a tough surface is installed at the body. The Velcro with a tough surface installed at the body is installed in a circumferential shape about the hinge part 31 so that the position where the second variable visor part 32*a* is fixed can be adjusted.

The present invention according to another embodiment of the present invention will be described.

Figure 5:
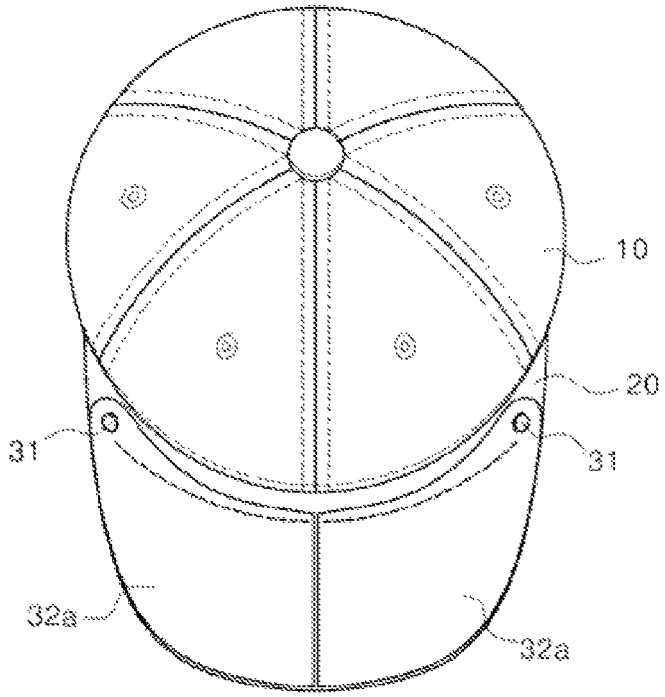
FIG. 5 is a perspective view illustrating a visor cap having variable visors according to another embodiment of the present invention.
Figure 6:
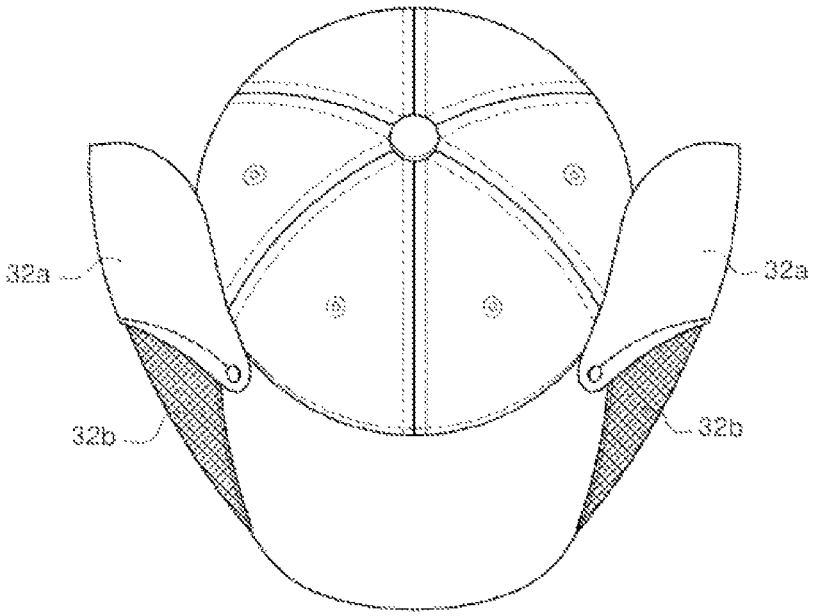
FIG. 6 is a view illustrating a change from FIG. 5.

FIG. 5 is a perspective view illustrating a visor cap having variable visors according to another embodiment of the present invention, and FIG. 6 is a view illustrating a change from FIG. 5.

As shown in FIG. 5, the pair of the variable visor parts 30*a* and 30*b* are hinged at the upper surface of the fixed visor 20, so it is possible to widen the visor area by expanding the second variable visor part 32*a* as shown in FIG. 6, if necessary.

Here, the second variable visor part 32*a* is manufactured in match with the shape of the fixed visor 20. If not necessary, the fixed visor 20 remains lifted-up over the upper surface of the fixed visor 20. In the event that it is expanded, the variable visor area can be widened by means of the first variable visor part 32*b*.

There is provided a fixing means for coupling the fixed visor and the variable visors in order for the variable visors to be fixed in a folded state, and it is preferred that the fixing means is a Velcro tape.

Figure 7:
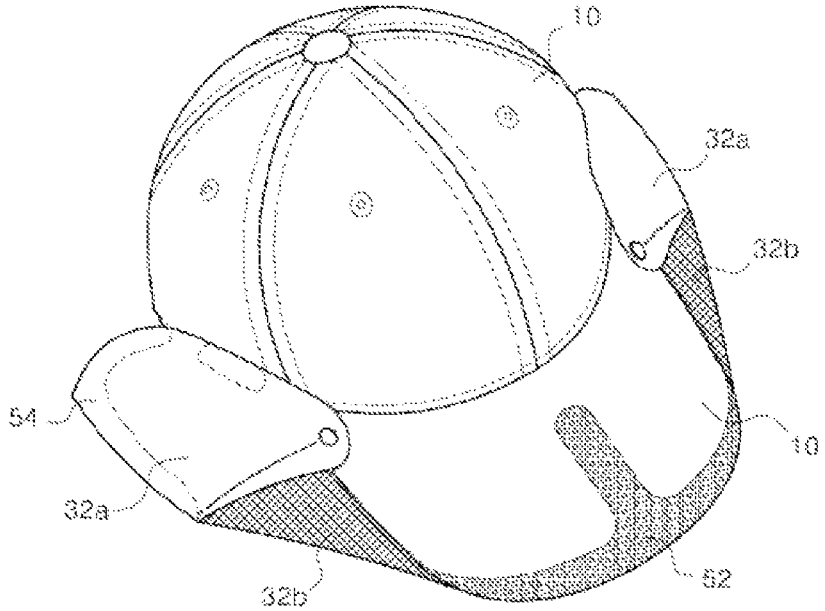
FIG. 7 is a perspective view illustrating a visor cap having variable visors according to further another embodiment of the present invention.
Figure 8:
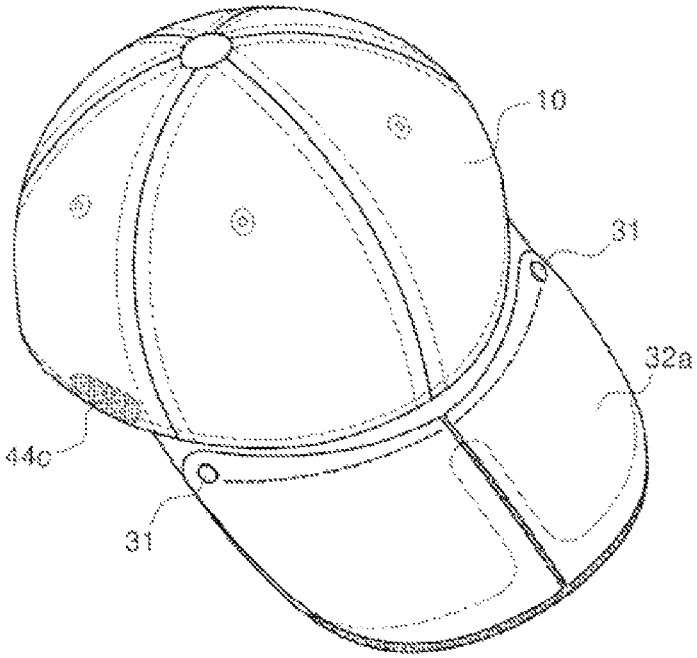
FIG. 8 is a view illustrating a change from FIG. 7.

FIG. 7 is a perspective view illustrating a visor cap having variable visors according to further another embodiment of the present invention, and FIG. 8 is a view illustrating a change from FIG. 7.

As shown in FIG. 7, Velcro tapes 52 and 54 are installed at the upper surface of the fixed visor 20 and beneath the second variable visor part 32*a*. As shown in FIG. 8, while the variable visor is folded, it keeps stably being fixed at the fixed visor 20.

As mentioned earlier, in the event that the Velcro tape is used as a coupling means, a Velcro with a smooth surface is installed at the second variable visor part 32*a*, and a Velcro 44*c* with a tough surface is installed at the body.

As the present invention may be embodied in several forms without departing from the spirit or essential characteristics thereof, it should also be understood that the above-described examples are not limited by any of the details of the foregoing description, unless otherwise specified, but rather should be construed broadly within its spirit and scope as defined in the appended claims, and therefore all changes and modifications that fall within the meets and bounds of the claims, or equivalences of such meets and bounds are therefore intended to be embraced by the appended claims.

The invention claimed is:

1. A visor cap, comprising:

a cap body (10);

a fixed visor (20) coupled to the body (10) at a front of the body (10);

left and right hinges (31) respectively disposed at left and right sides of the fixed visor (20) at rear portions of the fixed visor (20); and a pair of left and right variable visor parts (30*a*, 30*b*) respectively coupled to the left and right sides of the fixed visor (20), wherein the left variable visor (30*a*) comprises, a first left variable visor part (32*b*) having a connection portion with the fixed visor (20), the connection portion extending from the left hinge (31) toward a front portion in a substantial length, a second left variable visor part (32*a*) coupled to the first left variable visor part (32*b*), the second left variable visor part (32*a*) having one end coupled to the left hinge (31), the second left variable visor part (32*a*) matching with a shape of the left side of the fixed visor (20), wherein the right variable visor (30*b*) comprises, a first right variable visor part (32*b*) having a connection portion with the fixed visor (20), the connection portion extending from the right hinge (31) toward a front portion in a substantial length, a second right variable visor part (32*a*) coupled to the first right variable visor part (32b), the second right variable visor part (32*a*) having one end coupled to the right hinge (31), the second right variable visor part (32*a*) matching with a shape of the right side of the fixed visor (20), wherein the first left/right variable visor parts (32*b*) provided in both sides of the fixed visor (20) are made of a woven material or a spandex woven material, wherein the second left/right variable visor parts (32*a*) provided in both sides of the fixed visor (20) are made of a synthetic resin, wherein the fixed visor (20) has left and right accommodation part (12) constructed to receive therein the left and right variable visor parts (30*a*, 30*b*) respectively.

2. The visor cap according to claim 1, wherein the body (10) has left and right coupling means for coupling the left and right variable visor parts (30*a*, 30*b*) respectively thereto, wherein the left and right variable visor parts (30*a*, 30*b*) are capable of being widen by the first left and right variable visor parts (32*b*).

3. The visor cap according to claim 2, wherein said coupling means is a snap button.

4. The visor cap according to claim 1, further comprising fixing units constructed to keep a folded state of the left and right variable visor parts (30*a*, 30*b*).

* * * * *